US011228109B2

(12) United States Patent
Namba

(10) Patent No.: US 11,228,109 B2
(45) Date of Patent: Jan. 18, 2022

(54) ANTENNA DEVICE

(71) Applicant: HARADA INDUSTRY CO., LTD., Tokyo (JP)

(72) Inventor: Masahito Namba, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 105 days.

(21) Appl. No.: 16/606,594

(22) PCT Filed: Apr. 20, 2018

(86) PCT No.: PCT/JP2018/016297
§ 371 (c)(1),
(2) Date: Oct. 18, 2019

(87) PCT Pub. No.: WO2018/203485
PCT Pub. Date: Nov. 8, 2018

(65) Prior Publication Data

US 2021/0119337 A1 Apr. 22, 2021

(30) Foreign Application Priority Data

May 1, 2017 (JP) ..... JP2017-091334

(51) Int. Cl.
*H01Q 9/04* (2006.01)
*H01Q 1/32* (2006.01)

(52) U.S. Cl.
CPC ..... *H01Q 9/0435* (2013.01); *H01Q 1/32* (2013.01); *H01Q 9/0421* (2013.01)

(58) Field of Classification Search
CPC ..... H01Q 9/0435; H01Q 9/0421; H01Q 1/32; H01Q 9/0414; H01Q 9/0442; H01Q 1/3208
See application file for complete search history.

(56) References Cited

U.S. PATENT DOCUMENTS

2004/0021606 A1* 2/2004 Shigihara ..... H01Q 9/0421 343/700 MS
2004/0252060 A1 12/2004 Matsubara et al.
(Continued)

FOREIGN PATENT DOCUMENTS

JP 2004312221 A 11/2004
JP 2005143027 A 6/2005
(Continued)

OTHER PUBLICATIONS

International Search Report in PCT/JP2018/016297 dated Jun. 26, 2018.
(Continued)

*Primary Examiner* — Hai V Tran
*Assistant Examiner* — Michael M Bouizza
(74) *Attorney, Agent, or Firm* — Global IP Counselors, LLP

(57) ABSTRACT

An antenna device is provided for a vehicle. The antenna device includes a substrate, an antenna element and a capacitor part. The substrate includes a pair of main surfaces which face opposite sides each other. The antenna element includes a metal plate part which is disposed over and separated from one of the main surfaces, and a metal leg part which extends from the metal plate part toward the substrate. The capacitor part is electrically connected to the metal plate part through the metal leg part and includes two or more capacitors connected in series.

14 Claims, 6 Drawing Sheets

(56) References Cited

U.S. PATENT DOCUMENTS

| | | | |
|---|---|---|---|
| 2005/0093748 | A1 | 5/2005 | Yuanzhu |
| 2005/0099340 | A1 | 5/2005 | Suzuki |
| 2006/0114159 | A1 | 6/2006 | Yoshikawa et al. |
| 2007/0279304 | A1 | 12/2007 | Chakam et al. |
| 2008/0186238 | A1 | 8/2008 | Noro et al. |

FOREIGN PATENT DOCUMENTS

| | | | |
|---|---|---|---|
| JP | 2005167960 | A | 6/2005 |
| JP | 3814271 | B2 | 8/2006 |
| JP | 2008193204 | A | 8/2008 |
| JP | 2008271326 | A | 11/2008 |
| WO | 2004070879 | A1 | 8/2004 |

OTHER PUBLICATIONS

International Preliminary Report on Patentability, dated Jun. 26, 2018.

* cited by examiner

ANTENNA DEVICE

TECHNICAL FIELD

An aspect of the present invention relates to an antenna device.

BACKGROUND ART

An antenna device, which transmits and receives radio waves used for radio broadcasting, GPS, ETC, and the like, is attached to a vehicle such as a car. Patent Literature 1 discloses a so-called air gap-type antenna device including a dielectric substrate provided on a ground conductor, and a radiation conductor plate which is formed of a metal plate disposed at a predetermined interval on the dielectric substrate. In Patent Literature 1, additional capacitor is formed between the ground conductor and each solder land soldered to a single leg extending from the radiation conductor plate. According to Patent Literature 1, in a case where the additional capacitor is formed, transmission and reception efficiency of the antenna is improved.

Patent Literature 1: Japanese Patent No. 3814271

SUMMARY

In Patent Literature 1, a dielectric substrate is interposed between a ground conductor and a solder land, thereby forming additional capacitor to be connected to a radiation conductor plate which is an antenna element. Capacitance of the additional capacitor changes according to a thickness of the dielectric substrate and a size of the solder land. Therefore, capacitance of the additional capacitor easily varies for each antenna device, and thus there is a problem in that it is not possible to sufficiently exhibit transmission and reception performance depending on the antenna device. That is, there is a problem in that the antenna device, in which transmission and reception efficiency of an antenna is not improved, is manufactured. Therefore, a method is desired which is capable of accurately setting the above-described additional capacitor.

An aspect of the disclosure is to provide an antenna device capable of accurately setting the additional capacitor to be connected to the antenna element.

According to an aspect of the disclosure, there is provided an antenna device for a vehicle including: a substrate including a pair of main surfaces which face opposite sides each other; an antenna element that includes a metal plate part which is provided over one of the main surfaces and is disposed to be separated from the one main surface, and a metal leg part which extends from the metal plate part toward the substrate and is fixed to the substrate; and a capacitor part electrically connected to the antenna element, in which the capacitor part is electrically connected to the metal plate part via the metal leg part and includes two or more capacitors connected in series.

In the antenna device, an electrostatic capacitance of the capacitor part to be connected to the antenna element is determined by the capacitors therein. Therefore, compared to a case where the capacitor part is formed using, for example, the substrate, a wiring provided on the substrate, and the like, it is possible to suppress a variation in the electrostatic capacitance of the capacitor part. Here, the capacitor part electrically connected to the antenna element includes two or more capacitors connected in series. In this case, it is possible to set a synthetic capacitance of the two or more capacitors connected in series to the electrostatic capacitance of the capacitor part. Therefore, it is possible to reduce the variation in the electrostatic capacitance of the capacitor part due to the capacitors. Therefore, according to the antenna device, it is possible to accurately set an additional capacitor to be connected to the antenna element.

The antenna device may further include a ground pattern provided in a first area of the substrate, in which the capacitor part is provided on a second area, which is different from the first area, of the substrate. In this case, for example, it is possible to suitably prevent the electrostatic capacitance of the capacitors in the capacitor part from being affected by the ground pattern. In addition, it is possible to prevent a parasitic capacitance due to the ground pattern, the substrate, and the wiring for connecting the capacitors from being generated at the capacitor part. Therefore, it is possible to further reduce the variation in the electrostatic capacitance of the capacitor part.

Each of the capacitors may have the same electrostatic capacitance, and the electrostatic capacitance of each of the capacitors may correspond to the product of an electrostatic capacitance of the capacitor part and the number of the capacitors in the capacitor part. In this case, it is possible to excellently reduce the variation in the electrostatic capacitance of the capacitor part.

The capacitors may be provided on the one of the main surfaces, and at least one of the capacitors may be disposed not to overlap the metal plate part. In this case, the electrostatic capacitance of the capacitor part is likely not to be affected by the metal plate part. Therefore, it is possible to more accurately set the additional capacitor to be connected to the antenna element.

The antenna device may receive circularly polarized radio waves through two-point feeding. In this case, it is possible to increase a wavelength capable of being received by the antenna device.

An opening part may be provided at a part of the metal plate part. In this case, it is possible to band-widen the wavelength capable of being received by the antenna device while suppressing a rise of manufacturing costs.

The antenna device may further include a shield case provided on an opposite side of the antenna element while interposing the substrate between the shield case and the antenna element, in which at least one of the capacitors may be disposed not to overlap the shield case. In this case, since it is possible to reduce the number of the capacitors which are capacitively coupled to the shield case, it is possible to suppress deterioration in performance of the antenna device.

The antenna device may further include an antenna provided on an opposite side of the substrate while interposing the antenna element between the antenna and the substrate, and receives radio waves in a different frequency band from the antenna element. In this case, the antenna device is capable of simultaneously transmitting and receiving the radio waves in a plurality of frequency bands.

According to an aspect of the present disclosure, it is possible to provide an antenna device capable of accurately setting additional capacitor connected to an antenna.

DESCRIPTION OF EMBODIMENTS

Hereinafter, preferable embodiments of the present invention will be described in detail with reference to the accompanying drawings. In description below, the same reference symbol is used for the same element or an element having the same function, and the description thereof will not be repeated.

An antenna device according to the present embodiment is a patch antenna for a vehicle and has a function of transmitting and receiving radio waves used for, for example, GPS, ETC, satellite radio, GNSS, and the like. The antenna device is connected to an in-vehicle external device through a cable. Hereinafter, an external housing of the antenna device and an inner wiring of the antenna device will not be described.

Figure 1:
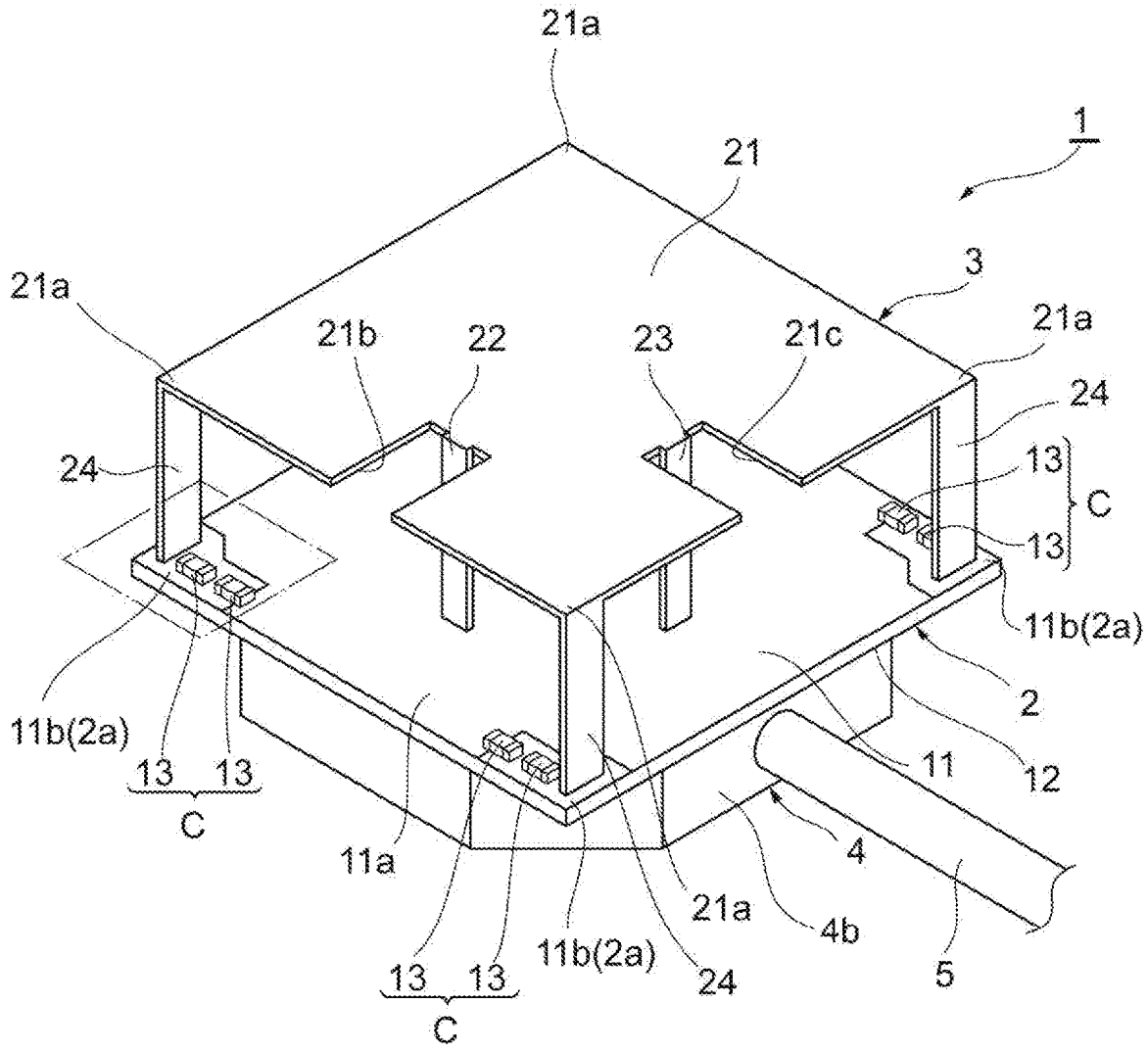
FIG. 1 is a schematic perspective diagram illustrating an antenna device according to an embodiment.
Figure 2:
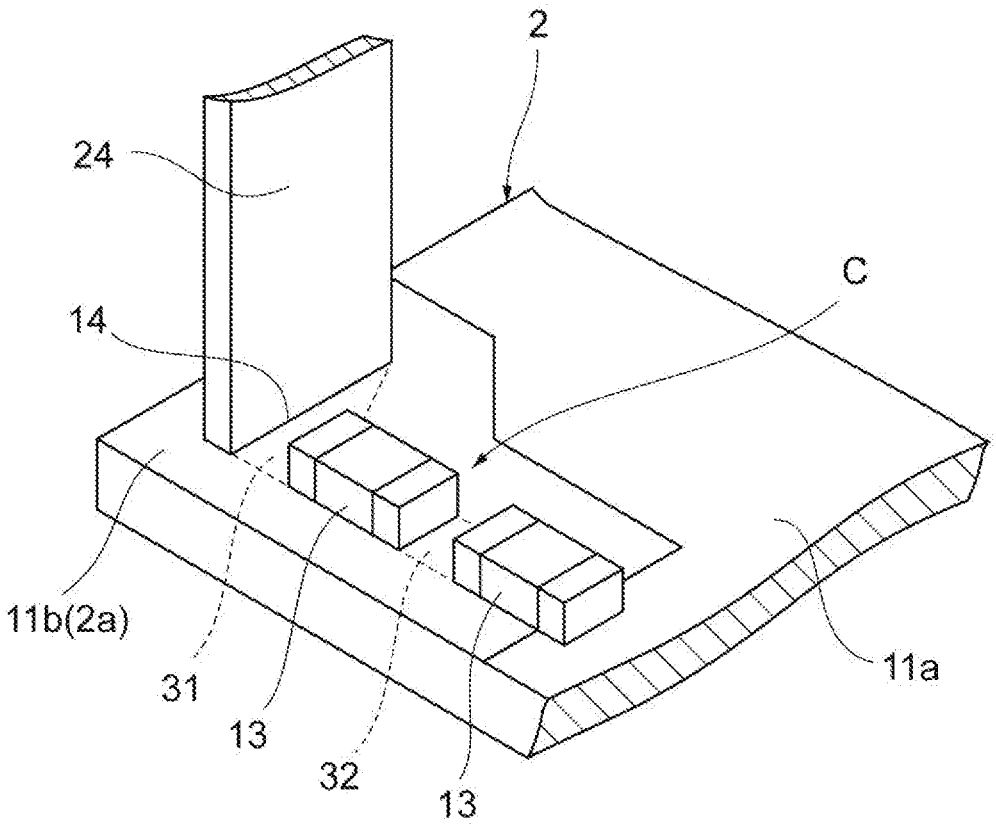
FIG. 2 is an enlarged diagram illustrating an area shown by a dashed line in FIG. 1.
Figure 3A:
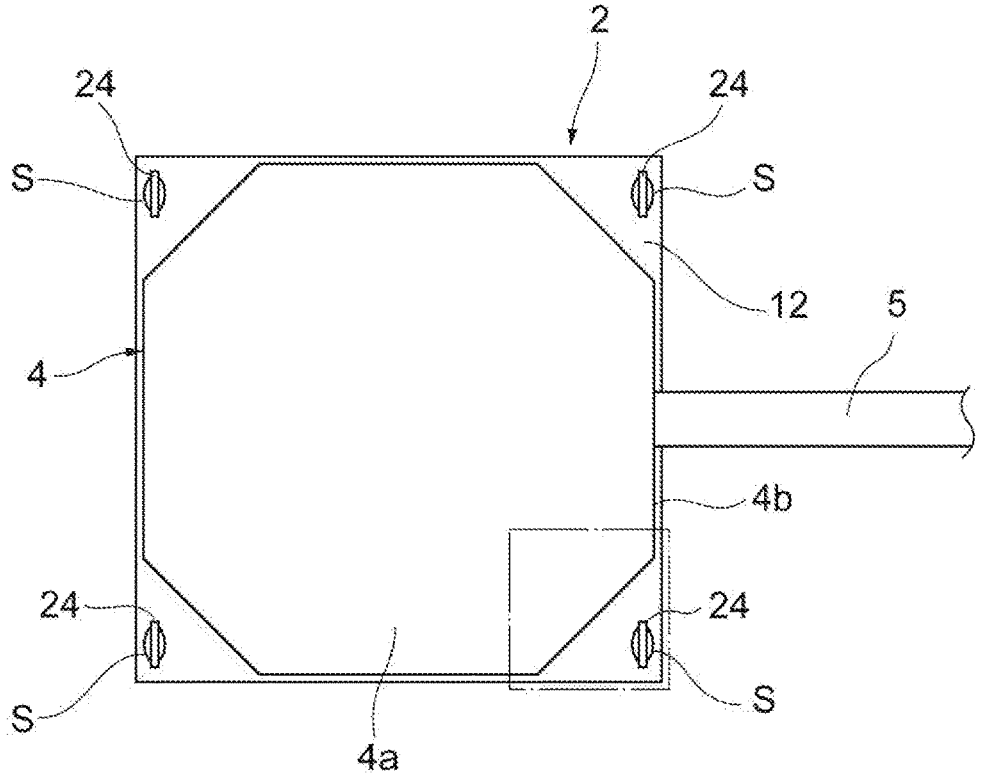
FIG. 3A is a schematic bottom diagram illustrating the antenna device according to the embodiment.
Figure 3B:
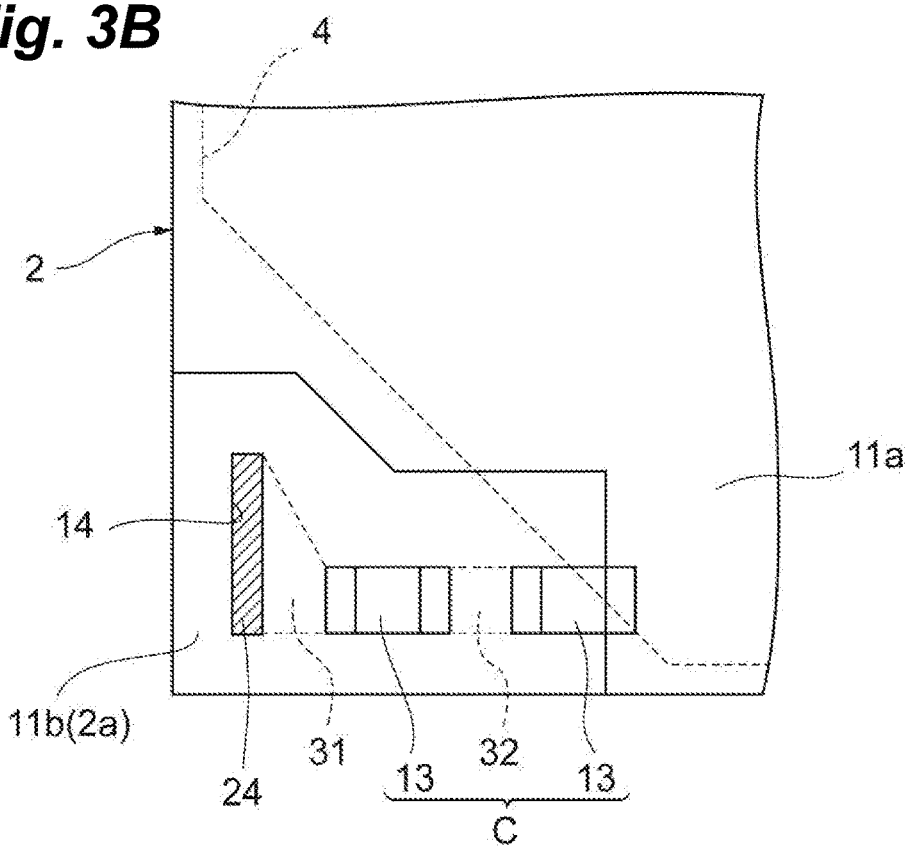
FIG. 3B is an enlarged plan diagram illustrating an area shown by a dashed line in FIG. 3A.

FIG. 1 is a schematic perspective diagram illustrating the antenna device according to the present embodiment. FIG. 2 is an enlarged diagram illustrating an area shown by a dashed line in FIG. 1. FIG. 3A is a schematic bottom diagram illustrating the antenna device according to the present embodiment. FIG. 3B is an enlarged plan diagram illustrating an area shown by a dashed line in FIG. 3A. The antenna device 1 illustrated in FIG. 1 to FIG. 3B includes a substrate 2 having a pair of main surfaces 11 and 12 which face opposite sides each other, an antenna element 3 provided on the main surface 11, a shield case 4 provided on the main surface 12, and a cable 5 which electrically connects the antenna element 3 to the external device. The antenna device 1 is configured such that the shield case 4, the substrate 2, and the antenna element 3 are overlapped in order. The shield case 4 is provided on an opposite side of the antenna element 3 while interposing the substrate 2 therebetween. Hereinafter, a direction, in which the substrate 2, the antenna element 3, and the shield case 4 are overlapped with each other, is referred to as a "stack direction". In the present embodiment, "viewed from the stack direction" corresponds to a "plan view".

The substrate 2 is a plate-shaped circuit board on which a ground pattern, a capacitor, an amplifier circuit, and the like are provided, and the antenna element 3 and the shield case 4 are attached thereto. Each of the main surfaces 11 and 12 of the substrate 2 has, for example, an approximately square shape. The ground pattern, a guidance wiring, and the capacitor with respect to the antenna element 3 are mainly provided on the main surface 11, and the amplifier circuit and the like are mainly provided on the main surface 12. Most parts (parts other than a spot which is connected to the antenna element 3 or the like) of the ground pattern and the guidance wiring, which are provided on the main surface 11, are covered by an insulating material such as a resin. In addition, the amplifier circuit or the like on the main surface 12 is covered by the shield case 4. The ground pattern provided on the main surface 11, the amplifier circuit provided on the main surface 12, and the like are not illustrated in the drawing.

A first area 11*a* and second areas 11*b*, which are different from each other, are set on the main surface 11. The first area 11*a* is an area which occupies most of the main surface 11, and, in contrast, the second areas 11*b* are areas corresponding to respective corners 2*a* of the substrate 2. In the present embodiment, total four second areas 11*b* are provided on the main surface 11. The ground pattern is provided on the first area 11*a*, and, in contrast, the ground pattern is not provided on the second area 11*b*. In addition, the ground pattern is not provided on the main surface 12 which overlaps the second areas 11*b*. Instead, a plurality of capacitors 13, which are included in the capacitor part C with respect to the antenna element 3, are provided on the respective second areas 11*b*. The capacitors 13 and the capacitor part C will be described in detail later.

A through hole 14 which extends in the stack direction is provided at each corner 2*a* of the substrate 2 (refer to FIG. 2 and FIG. 3B). A part (specifically, a metal leg part which will be described later) of the antenna element 3 is inserted into the through hole 14. A surface of the through hole 14 may be covered by a conductive layer which is a part of the guidance wiring that is different from the ground pattern. In this case, the antenna element 3 and the guidance wiring are suitably conducted in the through hole 14.

The antenna element 3 is a member which transmits and receives radio waves, and is formed by bending a metal plate or an alloy plate. The antenna element 3 includes a metal plate part 21 which is disposed to be separated from the main surface 11 of the substrate 2, feeding parts 22 and 23 which extend from the metal plate part 21 toward the main surface 11, and a plurality of metal leg parts 24 which extend from respective corners 21*a* of the metal plate part 21 toward the main surface 11 and are fixed to the substrate 2.

The metal plate part 21 is a part which transmits and receives the radio waves in the antenna element 3, and has an approximately quadrangle plate shape. As described above, the metal plate part 21 is disposed to be separated from the substrate 2, and there is a space provided between the metal plate part 21 and the substrate 2 in the stack direction. Therefore, the antenna device 1 according to the present embodiment is an air gap-type device, and air corresponds to a dielectric of the antenna device 1. When viewed from the stack direction, the metal plate part 21 is slightly smaller than the main surface 11 of the substrate 2. When viewed from the stack direction, an entirety of the metal plate part 21 overlaps the main surface 11. The metal plate part 21 is provided with two cutout parts 21*b* and 21*c* which are separated from each other. Each of the cutout parts 21*b* and 21*c* is provided to extend from an edge which forms the metal plate part 21 toward a center of the metal plate part 21 in a plan view. In a plan view, parts of the main surface 11 are exposed from parts which are cut out by the cutout parts 21*b* and 21*c*.

The feeding parts 22 and 23 are parts which electrically connect the metal plate part 21 to the wiring on the substrate 2, and have bar shapes which extend along the stack direction. The feeding part 22 is provided to protrude from a bottom of the cutout part 21*b* of the metal plate part 21 to the substrate 2. In the same manner, the feeding part 23 is provided to protrude from a bottom of the cutout part 21*c* of the metal plate part 21 to the substrate 2. The bottom of the cutout part is a portion located closest to a center of the metal plate part in the cutout part. As described above, since the two feeding parts 22 and 23 are provided, the antenna device 1 is capable of receiving circularly polarized radio waves through two-point feeding.

The metal leg parts 24 are parts, which are fixed to the substrate 2, of the antenna element 3, and have bar shapes which extend along the stack direction. The metal leg parts 24 are inserted into the corresponding through holes 14. Tips of the metal leg parts 24 are exposed from a side of the main surface 12. As illustrated in FIG. 3A, the tips of the metal leg parts 24 are fixed to the substrate 2 using, for example, solders S, respectively. The metal leg parts 24 are electrically connected to the capacitor parts C formed on the second area 11*b* of the main surface 11, respectively.

The metal plate part 21, the feeding parts 22 and 23, and the metal leg parts 24 are formed of the same metal plate or the same alloy plate. The respective feeding parts 22 and 23 are formed by bending, for example, parts which protrude from the bottoms of the corresponding cutout parts 21*b* and 21*c*. The metal leg parts 24 are formed by bending parts which protrude from the corners 21*a* of the metal plate part 21.

The shield case 4 is a member which reduces electromagnetic noises, and has conductivity. The shield case 4 is formed by bending, for example, one metal plate or one alloy plate. The shield case 4 includes a main part 4*a* which has an octagonal shape when viewed from the stack direction, and a wall part 4*b* which stands from an edge of the main part 4*a*. There is a space provided between the main part 4*a* located on an inner side than the wall part 4*b* in the shield case 4 and the main surface 12 of the substrate 2. The edge of the main part 4*a* is located on an inner side than an edge of the substrate 2. In a plan view, the through holes 14 provided in the substrate 2 are located on an outer side of the edge of the main part 4*a*. The metal leg parts 24 of the antenna element 3 are provided not to overlap the shield case 4 in the stack direction. As illustrated in FIG. 3B, the main part 4*a* overlaps a part of the second area 11*b*. A slit, a protrusion, or the like may be provided in at least any of the main part 4*a* and the wall part 4*b*. Although potential of the shield case 4 is set to, for example, reference potential (ground), the potential of the shield case 4 is not limited thereto.

Subsequently, the above-described capacitor part C will be described in detail. The capacitor part C is an additional capacitor for making up a shortage of an electrostatic capacitance formed by the antenna element 3 and the substrate 2, and is provided on each of the second areas 11*b*. In the present embodiment, four capacitor parts C are provided on the main surface 11, and the respective capacitor parts C are electrically connected to the corresponding metal leg parts 24. Each of the capacitor parts C includes the plurality of above-described capacitors 13, a wiring 31 for connecting the antenna element 3 to the capacitors 13, and a wiring 32 for connecting the capacitors 13 to each other. In the present embodiment, each of the capacitor parts C includes two capacitors 13, one wiring 31, and one wiring 32. In the present embodiment, total eight capacitors 13 are provided on the main surface 11.

The capacitor 13 is, for example, a two terminal-type multilayer ceramic chip capacitor, and has a predetermined electrostatic capacitance. The electrostatic capacitance of the plurality of capacitors 13 included in each capacitor part C may be the same with each other or may be different from each other. In each capacitor part C, the plurality of capacitors 13 are connected in series to each other on the second area 11*b*. As illustrated in FIG. 2 and FIG. 3B, the capacitor 13, which is disposed to be nearest to the metal leg part 24, of the plurality of capacitors 13, is electrically connected to the metal leg part 24 through the wiring 31. The adjacent capacitors 13 are connected in series to each other through the wiring 32. The respective capacitors 13 in the capacitor part C are electrically connected to the metal plate part 21 through the metal leg part 24. In the present embodiment, although the respective capacitors 13 are disposed in a linear shape, the disposition is not specifically limited. In other words, as long as the respective capacitors 13 are connected in series to each other, for example, the wiring 32 may be disposed to have a folded shape. In each second area 11*b*, the shapes of the wiring 31 and the wiring 32 and disposition states of the capacitors 13 may be different from each other. One terminal of the capacitor 13, which is farthest from the metal leg part 24 on an equivalent circuit, is electrically connected to the ground pattern. A part of the capacitor 13 in the capacitor part C may be located on the first area 11*a* (refer to FIG. 1 and FIG. 2).

A synthetic capacitance of the capacitors 13 included in the capacitor part C corresponds to an electrostatic capacitance of the capacitor part C. The electrostatic capacitance of the capacitor part C is smaller than the electrostatic capacitance of the respective capacitors 13. Here, in a case where the electrostatic capacitance of the capacitor part C is set to $\alpha$ and the electrostatic capacitance of the respective capacitors 13 are set to $\beta 1$ and $\beta 2$, the following Equation 1 is realized. In a case where the two capacitors 13 are included in the capacitor part C as in the present embodiment, the following Equation 2 is realized. In a case where the respective capacitors 13 included in the capacitor part C have the same electrostatic capacitance and the electrostatic capacitance of the respective capacitors 13 is set to $\beta 1$, the electrostatic capacitance $\alpha$ of the capacitor part C becomes $\beta 1/2$. That is, in the case where the respective capacitors 13 included in the capacitor part C have the same electrostatic capacitance, the electrostatic capacitance of each of the capacitors 13 included in the capacitor part C corresponds to the product of the electrostatic capacitance of the capacitor part C and the number of the capacitors 13 included in the capacitor parts C.

$$1/\alpha=1/\beta 1+1/\beta 2 \quad \text{Equation 1}$$

$$\alpha=\beta 1\times\beta 2/(\beta 1+\beta 2) \quad \text{Equation 2}$$

Subsequently, effects of the antenna device 1 according to the present embodiment will be described with reference to first and second comparative examples. An antenna device according to the first comparative example has the same configuration as the antenna device 1 according to the present embodiment other than a fact that the capacitor part includes one capacitor. In the first comparative example, the electrostatic capacitance of the one capacitor corresponds to the electrostatic capacitance of the capacitor part. An antenna device according to the second comparative example has the same configuration as the antenna device 1 according to the present embodiment other than a fact that the capacitor part includes parasitic capacitance of the multiple wiring. In the second comparative example, the sum of the parasitic capacitance between the multiple wiring and parasitic capacitance of a pair of wiring provided to interpose the substrate therebetween corresponds to the electrostatic capacitance of the capacitor part.

It is assumed that the electrostatic capacitance of the capacitor part is set to 0.5 pF and variation in all the capacitors is ±0.1 pF (that is, the electrostatic capacitance of the capacitor is in a range of 0.4 pF to 0.6 pF) (hereinafter, simply referred to as "first assumption"). In a case of the first assumption, the electrostatic capacitance of the capacitor part according to the first comparative example is in the range of 0.4 pF to 0.6 pF. Alternatively, it is assumed that the electrostatic capacitance of the capacitor part is set to 0.75 pF and the variation in all the capacitors is ±0.1 pF (hereinafter, simply referred to as "second assumption"). In a case of the second assumption, the electrostatic capacitance of the capacitor part according to the first comparative example is in a range of 0.65 pF to 0.85 pF. As above, in the first comparative example, the electrostatic capacitance of the capacitor part has a variation of ±0.1 pF. Here, the variation in the electrostatic capacitance of the capacitor part corresponds to a peak variation in the resonant frequency of the antenna device. For example, in a case where the antenna device transmits and receives the radio waves used for the GPS, a variation of ±0.1 pF corresponds to a fact that the resonant frequency varies by ±80 MHz from a predetermined frequency. Therefore, depending on the variation in the electrostatic capacitance, there is a case where the gain, which is acquired when the predetermined frequency is received, of the antenna device may be largely deteriorated from an ideal value. Therefore, in the first comparative example, there is a problem in that a transmission and reception property of the antenna may not be sufficiently exhibited.

In the second comparative example, in either the first assumption or the second assumption, an actually measured value of the electrostatic capacitance of the capacitor part tends to vary rather than at least the first comparative example. Therefore, in the second comparative example, there is a high possibility that the transmission and reception property of the antenna device is not sufficiently exhibited rather than the first comparative example.

Subsequently, the variation in the electrostatic capacitance of the capacitor part C according to the present embodiment will be considered. First, the first assumption will be considered in a case where the respective capacitors 13 included in the capacitor part C have the same electrostatic capacitance. At this time, the electrostatic capacitance of the respective capacitors 13 become 1.0 pF based on Equations 1 and 2. As described above, since it is assumed that the variation in the capacitors 13 is ±0.1 pF, a minimum value of the electrostatic capacitance of the capacitor part C corresponding to the synthetic capacitance of the capacitors 13 is 0.45 pF, and the maximum value thereof is 0.55 pF. In this case, the variation in the electrostatic capacitance of the capacitor part C is ±0.05 pF. The first assumption will be considered in a case where the respective capacitors 13 included in the capacitor part C have different electrostatic capacitance. At this time, since the electrostatic capacitance of the capacitor part C is set to 0.5 pF, the electrostatic capacitance of one of the two capacitors 13 included in the capacitor part C is set to 1.5 pF and the electrostatic capacitance of another capacitor 13 is set to 0.75 pF. In this case, since the minimum value of the electrostatic capacitance of the capacitor part C is 0.56 pF and the maximum value thereof is 0.44 pF, the variation in the electrostatic capacitance of the capacitor part C is ±0.06 pF.

The second assumption in a case where the respective capacitors 13 included in the capacitor part C have the same electrostatic capacitance will be considered. At this time, the electrostatic capacitance of the respective capacitors 13 is 1.5 pF based on Equations 1 and 2. Since it is assumed that the variation in the capacitors 13 is ±0.1 pF, the minimum value of the electrostatic capacitance of the capacitor part C corresponding to the synthetic capacitance of the capacitors 13 becomes 0.8 pF and the maximum value becomes 0.7 pF. In this case, the variation in the electrostatic capacitance of the capacitor part C is ±0.05 pF. In addition, the second assumption will be considered in a case where the respective capacitors 13 included in the capacitor part C have the different electrostatic capacitance. At this time, since the electrostatic capacitance of the capacitor part C is set to 0.75 pF, the electrostatic capacitance of one of the two capacitors 13 included in the capacitor parts C is set to 1 pF and the electrostatic capacitance of another capacitor 13 is set to 3 pF. In this case, since the minimum value of the electrostatic capacitance of the capacitor part C becomes 0.688 pF and the maximum value thereof becomes 0.812 pF, the variation in the electrostatic capacitance of the capacitor part C is ±0.062 pF.

Therefore, in either the first or second assumption, the electrostatic capacitance of the capacitor part C according to the present embodiment is likely not to vary rather than the first and second comparative examples regardless of a relationship between the electrostatic capacitance of the capacitors 13 included in the capacitor part C. Therefore, in the present embodiment, a gain, which is acquired in the case where the predetermined frequency is received, of the antenna device is likely not to be deteriorated rather than the first and second comparative examples. In addition, since the electrostatic capacitance of the capacitor part C corresponds to the synthetic capacitance of the plurality of capacitors 13, a distribution of the variation in the electrostatic capacitance of the capacitor part C tends to be small. In other words, a probability that the electrostatic capacitance of the capacitor part C becomes a set value or be close to the set value tends to be high.

Figure 4:
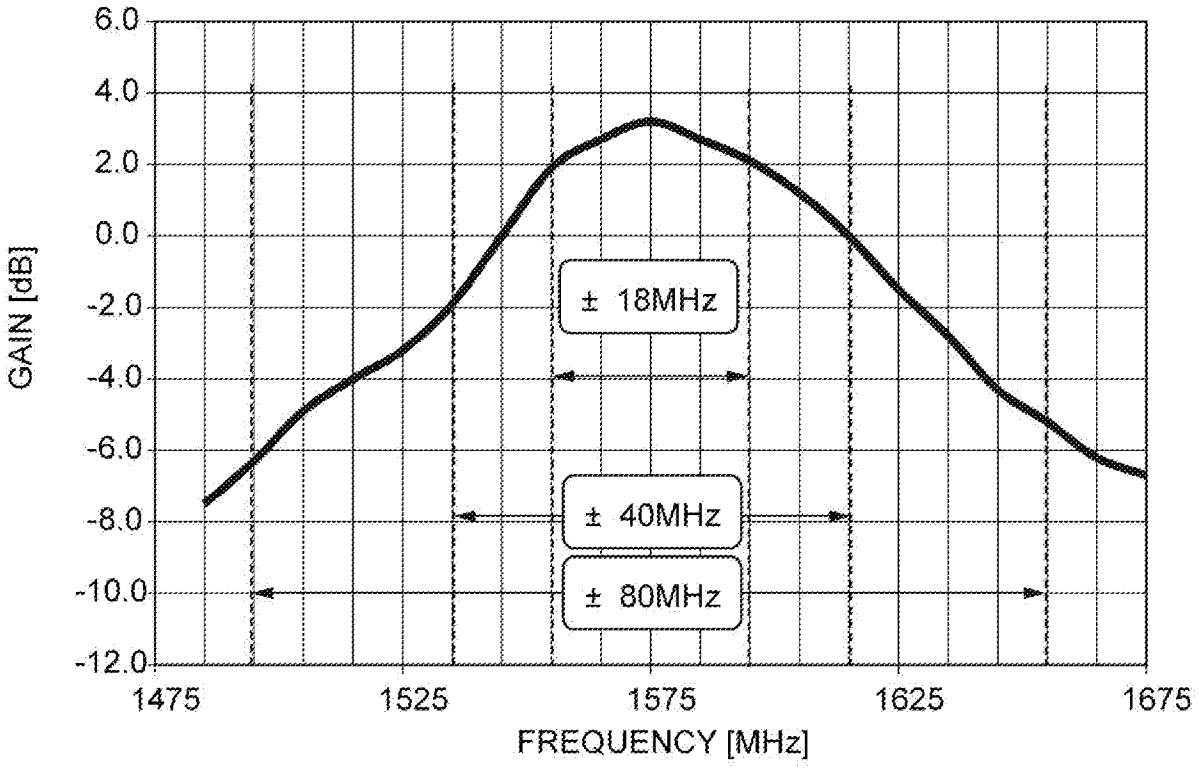
FIG. 4 is a graph illustrating an example of a gain with respect to a resonant frequency in the antenna device which transmits and receives radio waves used for GPS.

Here, with reference to FIG. 4, an influence of the gain of the antenna device accompanying a change in the electrostatic capacitance of the capacitor part will be described using a detailed example. FIG. 4 is a graph illustrating an example of a gain with respect to the resonant frequency in an antenna device which transmits and receives the radio waves used for the GPS. In FIG. 4, a horizontal axis indicates a frequency and a vertical axis indicates the gain. As illustrated in FIG. 4, in a case where the electrostatic capacitance of the capacitor part is the ideal value, setting is performed such that the gain of the antenna device becomes the largest at a frequency (approximately 1575 MHz) of the radio wave used for the GPS. In contrast, in a case where the electrostatic capacitance of the capacitor part deviates from the ideal value, a maximum value of the gain is located at a spot which is different from the frequency (approximately 1575 MHz). For example, the larger the electrostatic capacitance becomes, the closer the maximum value of the gain to a side of a low frequency. The smaller the electrostatic capacitance, the closer the maximum value of the gain to a side of a high frequency. Therefore, as the antenna device is resonated at a frequency separated from the above frequency, the gain is reduced at the frequency of the radio wave used for the GPS.

The capacitor part according to the first comparative example is applied as the capacitor part of the antenna device. In this case, as described above, the resonant frequency varies by at most approximately ±80 MHz from the predetermined frequency (approximately 1575 MHz). In this case, the gain of the antenna device at the predetermined frequency is reduced by at most 9 dB or more. In a case where the capacitor part according to the second comparative example is applied, there is a case where the gain of the antenna device at the predetermined frequency is further reduced. In contrast, in the embodiment, the variation in the capacitor part C is suppressed up to at most ±0.05 pF. In this case, the variation in the resonant frequency of the antenna device is suppressed up to at most approximately ±40 MHz. At this time, the reduction in the gain of the antenna device at the predetermined frequency becomes at most approximately 5 dB. In addition, in the present embodiment, in a case where it is assumed that the variation in each of the capacitors 13 is ±0.05 pF, the variation in the capacitor part C is suppressed up to at most ±0.025 pF. In this case, the variation in the resonant frequency of the antenna device C is suppressed up to at most approximately ±18 MHz. At this time, it is possible to suppress the reduction in the gain of the antenna device at the predetermined frequency up to at most approximately 1 dB. From the results, it is understood that the variation in the gain of the antenna device at the predetermined frequency is reduced by reducing the variation in the capacitor part.

Considering the above comparison results, according to the antenna device 1 of the present embodiment, it is possible to suppress the variation in the electrostatic capacitance of the capacitor part C, compared to the second comparative example in which the capacitor part is formed using, for example, the substrate, the wiring provided on the substrate, and the like. Here, the capacitor part C, which is electrically connected to the antenna element 3, includes the two capacitors 13 connected in series. At this time, it is possible to set the synthetic capacitance of the two capacitors 13 connected in series to the electrostatic capacitance of the capacitor part C. In this case, it is possible to reduce the variation in the electrostatic capacitance of the capacitor part C due to the capacitors 13, compared to the first comparative example in which one capacitor is included in the capacitor part. Therefore, according to the antenna device 1, it is possible to accurately set the additional capacitor to be connected to the antenna element 3.

The antenna device 1 includes the ground pattern provided in the first area 11*a* of the substrate 2, and the capacitor part C is provided on the second area 11*b* which is different from the first area 11*a* of the substrate 2. Therefore, for example, it is possible to suitably prevent the electrostatic capacitance of the capacitors 13 in the capacitor part C from being influenced by the ground pattern. In addition, at the capacitor part C, it is possible to prevent a capacitor from being formed by the ground pattern, the substrate, and the wiring 32 for connecting the capacitors 13. Therefore, it is possible to further reduce the variation in the electrostatic capacitance of the capacitor part C.

The respective capacitors 13 may have the same electrostatic capacitance, and the electrostatic capacitance of the respective capacitors 13 may correspond to the product of the electrostatic capacitance of the capacitor part C and the number of the capacitors 13 in the capacitor part C. In this case, it is possible to excellently reduce the variation in the electrostatic capacitance of the capacitor part C.

The antenna device 1 receives the circularly polarized radio wave by two-point feeding through the feeding parts 22 and 23. Therefore, it is possible to increase a wavelength capable of being received by the antenna device 1.

Figure 5:
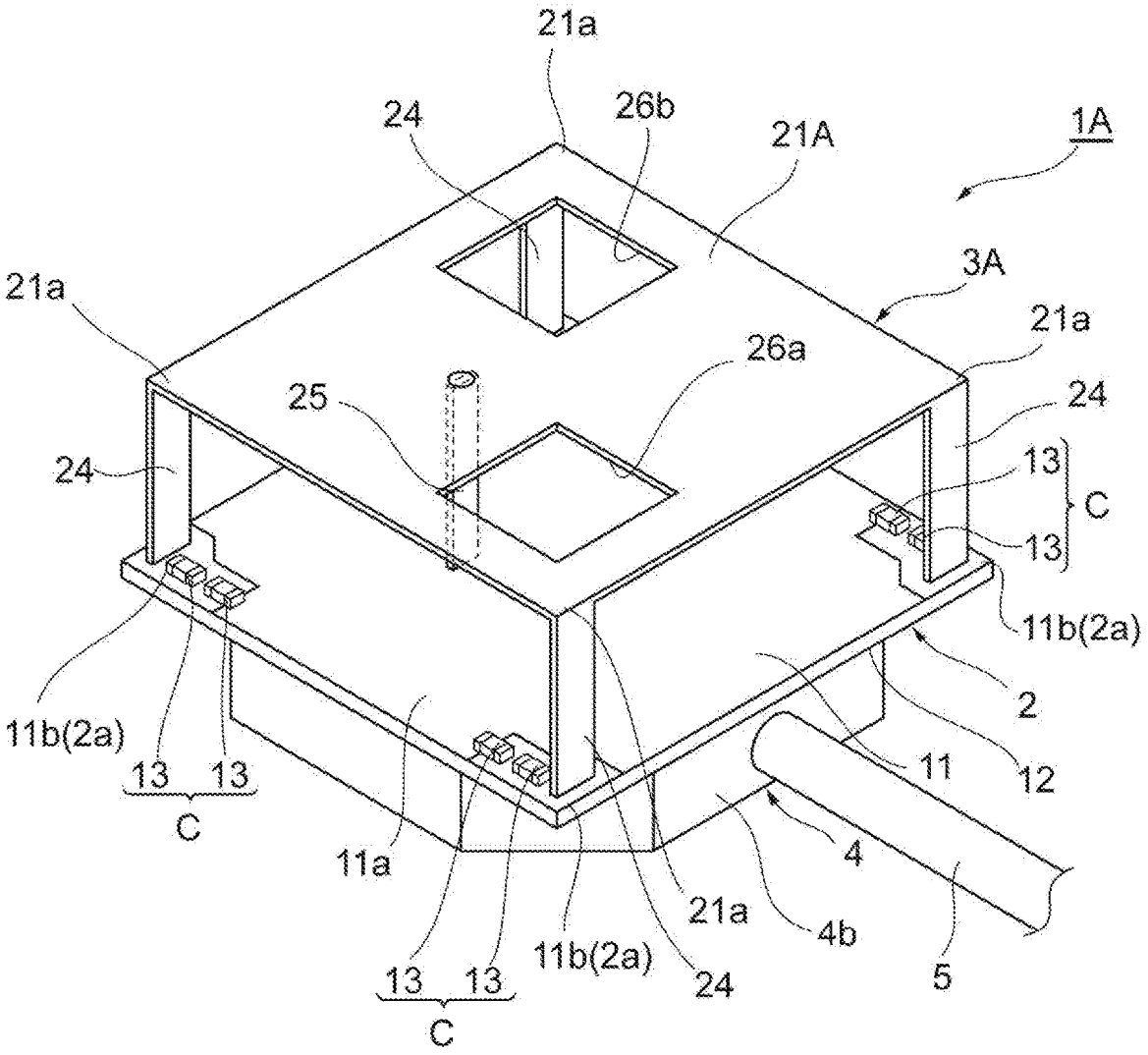
FIG. 5 is a schematic perspective diagram illustrating an antenna device according to a first modified example of the embodiment.

FIG. 5 is a schematic perspective diagram illustrating an antenna device according to a first modified example of the present embodiment. As illustrated in FIG. 5, an antenna element 3A of an antenna device 1A is not provided with the feeding parts 22 and 23, and is provided with a feeding part 25 which extends from a center of the metal plate part 21A toward the substrate 2. In addition, the metal plate part 21A is provided with opening parts 26*a* and 26*b*. The opening parts 26*a* and 26*b* may have the same shapes with each other, or may have different shapes from each other. The opening parts 26*a* and 26*b* may have a point symmetry relationship with respect to the center of the metal plate part 21A. In the first modified example, it is possible to bandwiden the wavelength capable of being received by the antenna device 1A while suppressing a rise of manufacturing costs. The number of opening parts provided in the metal plate part may be one or may be three or more. The metal plate part 21A may be provided with cutouts part instead of the opening parts.

Figure 6:
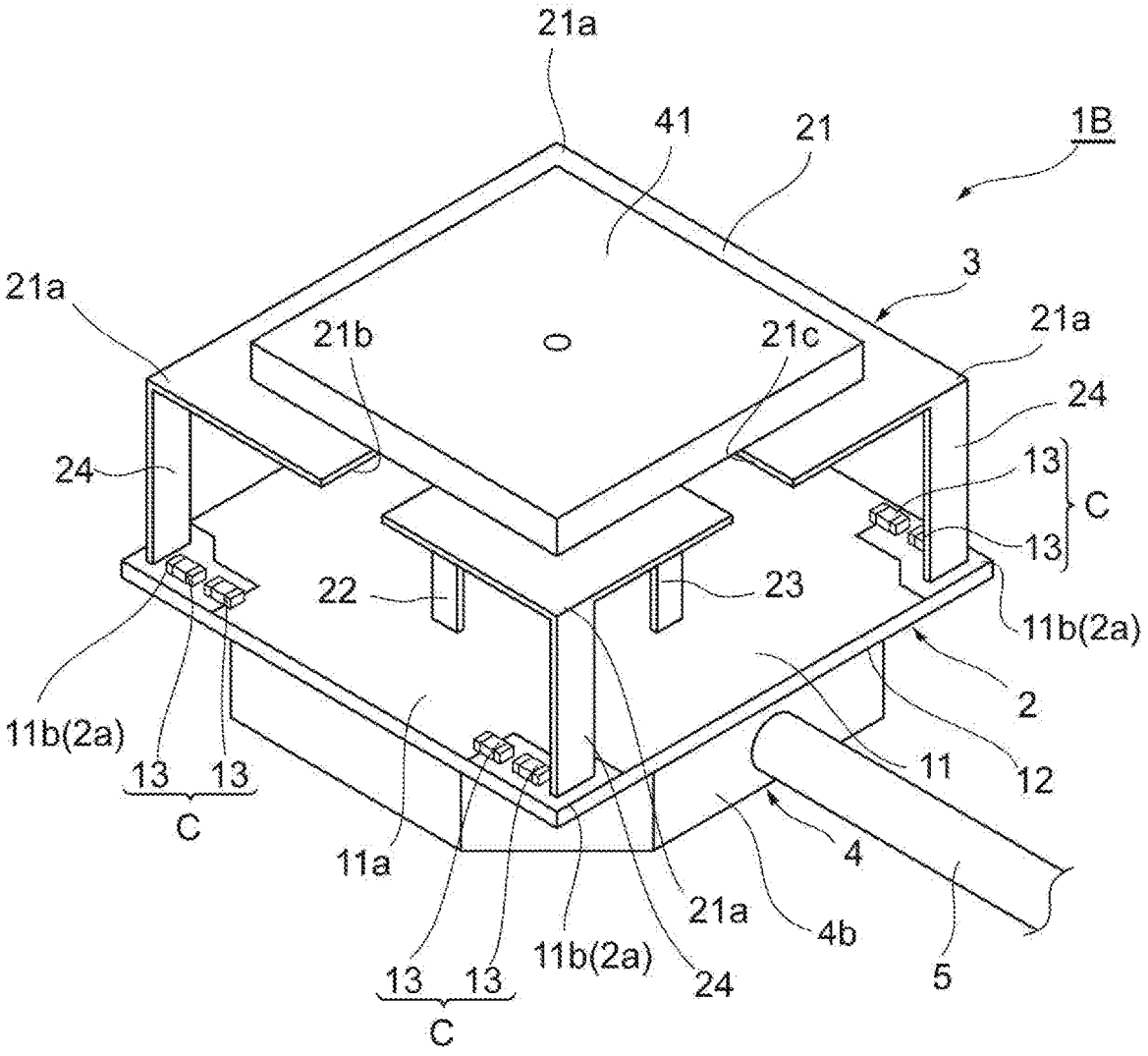
FIG. 6 is a schematic perspective diagram illustrating an antenna device according to a second modified example of the embodiment.

FIG. 6 is a schematic perspective diagram illustrating an antenna device according to a second modified example of the present embodiment. As illustrated in FIG. 6, an antenna device 1B is provided with an antenna 41 on an opposite side of the substrate 2 while interposing the metal plate part 21 between the antenna 41 and the substrate 2. The antenna 41 is an antenna which receives a radio wave in a different frequency band of the antenna element 3, and is a ceramic patch antenna provided on the metal plate part 21. According to the second modified example, the antenna device 1B is capable of simultaneously transmitting and receiving radio waves in a plurality of frequency bands. The antenna 41 may be an antenna which receives the radio wave in the different frequency band of the antenna element 3, and the antenna 41 is not limited to the ceramic patch antenna.

An antenna device according to an aspect of the present invention is not limited to the above-described embodiment and the modified examples, and other various modifications are possible. The embodiment and the modified examples may be appropriately combined. For example, the first modified example may be combined with the second modified example, and the antenna 41 may be provided on the antenna device 1A. In a case where the number of feeding parts is one as in the first modified example, the opening parts 26*a* and 26*b* may not be essentially provided in the metal plate part 21. In the first modified example, the number of opening parts provided in the metal plate part 21 is not limited.

In the embodiment and the modified examples, the ground pattern, the guidance wiring, and the capacitor with respect to the antenna element 3 are mainly provided on the main surface 11 and the amplifier and the like are mainly provided on the main surface 12. However, the present invention is not limited thereto. For example, the ground pattern, the amplifier circuit, and the like may be provided on both sides of the main surfaces 11 and 12.

In the embodiment and the modified examples, at least one capacitor 13 of the capacitors 13 provided on the main surface 11 may be disposed to be not overlapped with the metal plate part 21 in the stack direction. In this case, the electrostatic capacitance of the capacitor part C is likely not to be affected by the metal plate part 21. Therefore, it is possible to more accurately set the additional capacitor to be connected to the antenna element 3.

In the embodiment and the modified examples, at least one capacitor 13 of the capacitors 13 provided on the main surface 11 may be disposed to be not overlapped with the shield case 4 in the stack direction. In this case, since it is possible to reduce the number of the capacitors 13 which are capacitively coupled to the shield case 4, the electrostatic capacitance of the capacitor part C is likely not to be affected by the shield case 4. Therefore, since it is possible to more accurately set the additional capacitor to be connected to the antenna element 3, it is possible to suppress deterioration in performance of the antenna device 1. All the capacitors 13 may be disposed to be not overlapped with the shield case 4 in the stack direction.

In the embodiment and the modified examples, the electrostatic capacitance of the respective capacitor parts C may be different. For example, an optimal electrostatic capacitance according to the corresponding metal leg part 24 may be set to the capacitor part C. That is, the number of the capacitors 13 included in each of the capacitor parts C may be different. The number of the capacitors 13 included in at least a part of the capacitor parts C may be one or two or more. For example, in a case where the number of the capacitors 13 included in the capacitor part C is three, the electrostatic capacitance of the capacitor part C is set to $\alpha$, and the electrostatic capacitance of the respective capacitors 13 are set to $\beta 1$, $\beta 2$, and $\beta 3$, the following Equation 3 is established. In a case where the respective capacitors 13 included in the capacitor part C have the same electrostatic capacitance and the electrostatic capacitance of the respective capacitors 13 are set to $\beta 1$, the electrostatic capacitance $\alpha$ of the capacitor part C becomes $\beta 1/3$. Therefore, in a case where the number of the capacitors 13 included in the capacitor part C is three or more and the respective capacitors 13 included in the capacitor part C have the same electrostatic capacitance, the electrostatic capacitance of the respective capacitors 13 included in the capacitor parts C correspond to the product of the electrostatic capacitance of the capacitor part C and the number of the capacitors 13 included in the capacitor part C.

$$1/\alpha=1/\beta 1+1/\beta 2+1/\beta 3 \qquad \text{Equation 3}$$

In the embodiment and the modified examples, in a case where the number of the capacitors 13 included in the capacitor part C is three or more, all the capacitors 13 may have the same electrostatic capacitance. Therefore, it is possible to further excellently reduce the variation in the electrostatic capacitance of the capacitor part C. In addition, the distribution of the variation in the electrostatic capacitance of the capacitor part C tends to be small. The capacitor part C may not be provided at a part of the second areas 11*b*.

In the embodiment and the modified examples, at least some of the capacitors 13 included in the capacitor parts C may be provided on the main surface 12. In this case, it is possible to reduce an area of the second areas 11*b* while securing the electrostatic capacitance of the capacitor part C. At least one capacitor 13 in the capacitor parts C may be disposed to be not overlapped with the metal plate part 21. In this case, the electrostatic capacitance of the capacitor part C is likely not to be affected by the metal plate part 21. Therefore, it is possible to more accurately set the additional capacitor to be connected to the antenna element 3. The second area 11*b* provided with the capacitor part C may not be essentially provided at the corner 2*a* of the substrate 2. Therefore, some of the capacitors 13 may be provided other than the corner 2*a* of the substrate 2.

In the embodiment and the modified examples, the main part 4*a* of the shield case 4 is provided to overlap at least some of the capacitors 13. However, the present invention is not limited thereto. For example, the main part 4*a* may be provided to overlap all the capacitors 13, or may be provided not to overlap all the capacitors 13.

REFERENCE SIGNS LIST

1, 1A, 1B antenna device
2 substrate
2*a* corner
3 antenna element
4 shield case
4*a* main part
4*b* wall part
5 cable
11, 12 main surface
11*a* first area
11*b* second area
13 capacitor
14 through hole
21, 21A metal plate part
21*a* corner
21*b*, 21*c* cutout part
22, 23, 25 feeding part
24 metal leg part
26*a*, 26*b* opening part
31 wiring
32 wiring
41 antenna
C capacitor part

The invention claimed is:

1. An antenna device for a vehicle comprising:
a substrate including a pair of main surfaces which face opposite sides each other;
an antenna element including:
a metal plate part which is disposed over and separated from one of the main surfaces; and
a metal leg part which extends from the metal plate part toward the substrate and is fixed to the substrate;
a capacitor part electrically connected to the antenna element; and
a shield case arranged to overlap the substrate in a stack direction, the shield case being provided on an opposite side of the antenna element while interposing the substrate between the shield case and the antenna element in the stack direction,
wherein the capacitor part is electrically connected to the metal plate part via the metal leg part and includes two or more capacitors connected in series, and
wherein at least one of the capacitors is disposed not to overlap the shield case in the stack direction.

2. The antenna device according to claim 1, further comprising
a ground pattern provided in a first area of the substrate,
wherein the capacitor part is provided on a second area, which is different from the first area, of the substrate.

3. The antenna device according to claim 1,
wherein each of the capacitors has the same electrostatic capacitance, and
wherein the electrostatic capacitance of each of the capacitors corresponds to the product of an electrostatic capacitance of the capacitor part and the number of the capacitors in the capacitor part.

4. The antenna device according to claim 1,
wherein the capacitors are provided on the one of the main surfaces, and
wherein at least one of the capacitors is disposed not to overlap the metal plate part.

5. The antenna device according to claim 1,
wherein the antenna device is configured to receive circularly polarized radio waves through two-point feeding.

6. The antenna device according to claim 1,
wherein an opening part is provided at a part of the metal plate part.

7. The antenna device according to claim 1, further comprising
an antenna provided on an opposite side of the substrate while interposing the antenna element between the antenna and the substrate, the antenna being configured to receive-radio waves in a different frequency band from the antenna element.

8. An antenna device for a vehicle comprising:

a substrate including a first main surface and a second main surface on an opposite side of the substrate from the first main surface;

an antenna element including:

a plate part disposed over and separated from the first main; and a leg part extending from the plate part toward the substrate, the leg part being fixed to the substrate;

a capacitor part electrically connected to the antenna element; and a shield case arranged to overlap the substrate in a stack direction, the shield case being provided on an opposite side of the antenna element while interposing the substrate between the shield case and the antenna element in the stack direction, wherein the capacitor part is electrically connected to the plate part via the leg part and includes two or more capacitors connected in series, and wherein at least one of the capacitors is disposed not to overlap the shield case in the stack direction.

9. The antenna device according to claim 8, further comprising a ground pattern provided in a first area of the substrate, wherein the capacitor part is provided on a second area, which is different from the first area, of the substrate.

10. The antenna device according to claim 8, wherein each of the capacitors has the same electrostatic capacitance, and wherein the electrostatic capacitance of each of the capacitors corresponds to the product of an electrostatic capacitance of the capacitor part and the number of the capacitors in the capacitor part.

11. The antenna device according to claim 8, wherein the capacitors are provided on the first main surface, and wherein at least one of the capacitors is disposed not to overlap the plate part.

12. The antenna device according to claim 8, wherein the antenna device is configured to receive circularly polarized radio waves through two-point feeding.

13. The antenna device according to claim 8, wherein an opening part is provided at the plate part.

14. The antenna device according to claim 8, further comprising an antenna provided on an opposite side of the substrate while interposing the antenna element between the antenna and the substrate, the antenna being configured to receive radio waves in a different frequency band from the antenna element.

* * * * *